United States Patent [19]

Blackburn

[11] Patent Number: 5,010,533

[45] Date of Patent: Apr. 23, 1991

[54] DIAL FACE FOR CLOCK OR WATCH

[75] Inventor: Bruce N. Blackburn, Pelham, N.Y.

[73] Assignee: Bernard Weinstein, New York, N.Y.

[21] Appl. No.: 488,571

[22] Filed: Mar. 2, 1990

Related U.S. Application Data

[60] Division of Ser. No. 441,747, Nov. 27, 1989, which is a continuation-in-part of Ser. No. 260,411, Oct. 20, 1988, Pat. No. 4,884,256.

[51] Int. Cl.[5] ..... G04B 19/00

[52] U.S. Cl. ..... 368/223; 368/228; 368/232

[58] Field of Search ..... 368/110, 223-239

[56] References Cited

U.S. PATENT DOCUMENTS

| | | | |
|---|---|---|---|
| D. 69,193 | 1/1926 | Whitehead . | |
| D. 140,234 | 2/1945 | Thompson | D42/10 |
| D. 151,204 | 10/1948 | Adamson | D42/10 |
| D. 198,577 | 7/1964 | Lavitol | D42/1 |
| D. 250,004 | 10/1978 | Quigley et al. | D10/74 |
| D. 282,723 | 2/1986 | MacNeal | D10/1 |
| 360,641 | 4/1887 | Adam . | |
| 2,023,934 | 4/1935 | Moise | 58/50 |
| 2,168,314 | 8/1939 | Blanks | 58/126 |
| 2,188,872 | 1/1940 | Carlson | 58/126 |
| 3,177,646 | 4/1965 | Ernest et al. | 58/2 |
| 3,952,500 | 4/1976 | Tomura | 58/126 D |
| 4,094,464 | 6/1978 | Kawamura et al. | 239/17 |
| 4,241,442 | 12/1980 | Grohoski | 368/294 |
| 4,497,312 | 2/1985 | Byrd | 128/1 R |
| 4,681,463 | 7/1987 | Bendit | 368/110 |
| 4,702,616 | 10/1987 | Kizawa | 368/223 |
| 4,706,238 | 10/1987 | Kizawa | 368/296 |

FOREIGN PATENT DOCUMENTS

| | | |
|---|---|---|
| 43831 | 12/1971 | Japan . |
| 338401 | 6/1959 | Switzerland . |
| 450298 | 4/1968 | Switzerland . |
| 772228 | 4/1957 | United Kingdom . |

*Primary Examiner*—Bernard Roskoski

*Attorney, Agent, or Firm*—Pennie & Edmonds

[57] ABSTRACT

An apparatus for indicating time featuring a face having a stationary helical member positioned about a central point so that the distance between any point upon the helical member and a horizontal base plane increases in a clockwise direction around the circumference of the helical member. The face also includes a step member connecting the ends of the helical member along two radially extending common edges to form a continuous surface. At least one of these edges corresponds to the 12 o'clock position of the face thereby defining an indicia from which elapsed time is measured. Also, the face can include a plurality of members mounted upon a horizontal base plane and positioned about a central point. Each member is made of first and second planes of different areas which are angled with respect to the base plane and which intersect to form a common edge therebetween. The edges of the members extend toward the central point or terminate prior to that point to form a central face opening. The horizontal base plane forms the outer perimeter of the face to facilitate attachment of a crystal. Furthermore, the apparatus is equipped with hands which rotate relative to the face and means for attachment to a watchband, wall or other such surface.

28 Claims, 4 Drawing Sheets

DIAL FACE FOR CLOCK OR WATCH

This application is a division of application Ser. No. 07/441,747, filed Nov. 27, 1989, which is a continuation-in-part of application Ser. No. 07/260,411, filed Oct. 20, 1988, now U.S. Pat. No. 4,884,256.

TECHNICAL FIELD

The invention relates to a timepiece, in particular to a watch or clock having various distinctive three dimensional dial faces.

BACKGROUND ART

Various ornamental watches have been developed whereby the face of the Watch has an artistic quality. Typical examples of such watches or watch faces can be found in U.S. Design Pat. Nos. 140,234 (clock dial); 151,204 (watch dial) and 282,723 (clock). With the exception of the last reference, all of these and many other ornamental watches rely on numerals or at least one other indicia to assist in time telling.

Alternatively, other ornamental watches illustrate a dial face having a combination of numerals and raised portions. For example, Swiss Pat. No. 450,298 relates to a timepiece dial having a plurality of raised triangularly shaped members extending radially towards the dial center, and a smooth outer ring having raised figures consisting of the dial's time marks.

Swiss Pat. No. 338,401, on the other hand, illustrates a timepiece dial having a plurality of radial lines which correspond to the hours of the day. In addition, the dial is equipped with a pair of faceted pointers at the 6 and 12 hour marks.

None of these prior art timepieces, however, exhibit the distinctive three dimensional helical qualities of the invention and are capable of clearly and accurately indicating time solely by the construction of their faces.

SUMMARY OF THE INVENTION

The present invention relates to an apparatus for indicating time comprising a face having a stationary helical member and a step member connecting the ends of the helical member to form a continuous surface. The helical member is positioned about a central point such that the distance from any point upon the helical member to a horizontal base plane increases along the circumference of the helical member.

According to one embodiment of the invention, the distance from the base plane to any point upon the helical member increases in a clockwise direction. Alternatively, the distance may increase in the counterclockwise direction.

The connection of the helical member and the step member forms upper and lower common edges which extend radially towards the central point. These edges may be parallel to the horizontal base plane, or form an angle therewith. Preferably, at least one of these radial edges defines an indicia from which elapsed time is measured. For example, one edge may correspond to a 12 o'clock position.

In addition, the apparatus is equipped with means for determining elapsed time. For example, hands which rotate around the central point of the face relative to the radial edges, or illumination of portions of the face in predetermined patterns representing time intervals, or a combination of moving hands and illuminating face portions.

The face and time determining means may be protected from external sources by a crystal having a periphery corresponding to the helical external periphery of the continuous surface. In particular, a loWer portion of the crystal periphery is configured to mate and engage the continuous surface, including the step member.

The invention also relates to a time indicating apparatus which includes a face having a plurality of stationary members positioned at an angle with respect to a horizontal base plane and arranged in a predetermined orientation relative to a central point. Each member comprises first and second planes which intersect to form a common edge therebetween. The first and second planes are of different areas and terminate in first and second plane boundaries, respectively. The boundary of a first plane of one member contacts a portion of a boundary of a second plane of an adjacent member.

Preferably, a preselected number of first planes respectively contact a portion of the boundaries of a preselected number of second planes of adjacent members, and form a symmetric pattern about the central point. In one embodiment, the members form a discontinuous surface about the central point, and are mounted upon and connected by the horizontal base plane. Also, these members can be oriented in a symmetric pattern forming a continuous surface around the central point, if desired.

The edges between the first and second planes of each member converge radially toward the central point. Also, these edges can terminate at a predetermined distance from the central point to form a shape therearound. Each of the members and planes thereof includes an outer periphery which is located within the outer perimeter of the horizontal base plane. In this arrangement, the horizontal base plane forms the outer perimeter of the face of the apparatus to facilitate connection of a standard crystal to the face without having a special mating configuration to the plane members.

In addition, the invention may be equipped with means for attaching the apparatus to a support member. For example, the apparatus may include posts for mounting a watchband, or a hook or a recess for mounting the invention to a wall or other surface.

The interior pattern of the watch may vary such that the radial edges of the continuous surface converge to the central point or terminate, prior to intersection at the central point, to form a closed area. Similarly, the perimeter of the face may have any number of shapes, such as circular, elliptical, rectangular or any other geometric shape, as desired.

BRIEF DESCRIPTION OF THE DRAWINGS

Further benefits and advantages of the invention will become apparent from consideration of the following description given with reference to the accompanying drawing figures which specify and show preferred embodiments of the invention, and wherein.

DETAILED DESCRIPTION OF THE PREFERRED EMBODIMENTS

Figure 1:
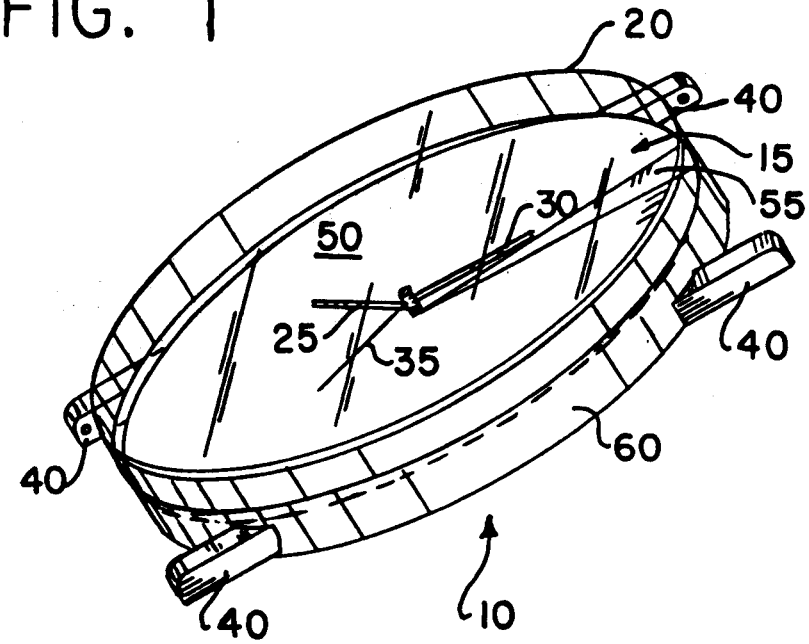
FIG. 1 is a perspective view of a watch having a face according to the invention.
Figure 2:
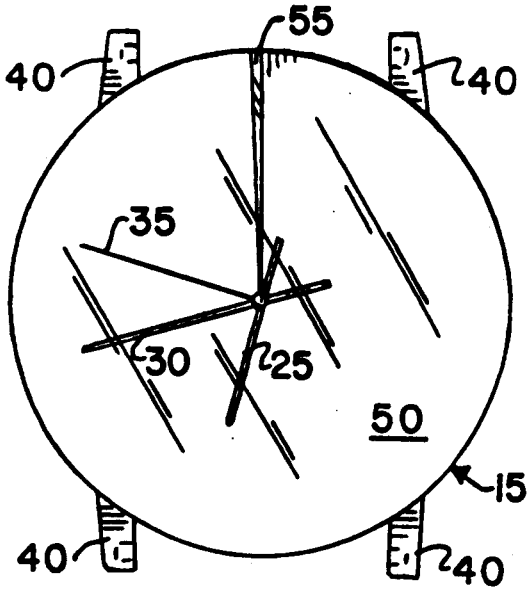
FIG. 2 is a front view of the watch of FIG. 1.
Figure 3:
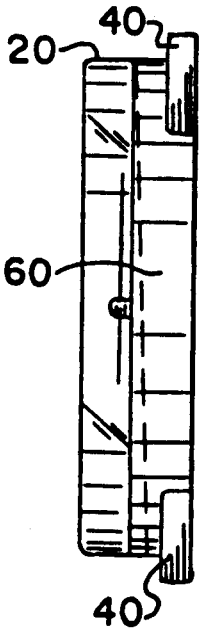
FIG. 3 is a side view of the watch of FIG. 1.

In the description that follows, reference is made to attached drawing FIGS. 1—3 showing a timepiece according to the invention. Portions of this timepiece are similar to that described in U.S. patent application Ser. No. 07/260,411 which is expressly incorporated herein by reference thereto. For information regarding alternate embodiments of the invention described herein, that inventors earlier patent may be reviewed.

Referring now to FIGS. 1—3 there is illustrated an apparatus for indicating time substantially in the form of a watch 10 comprising: a circular face 15; a matching crystal 20; an hour hand 25; a minute hand 30; a second hand 35; a central portion or stem 45; casing 60 for holding the hand movement mechanism; and a pair of posts 40 attached to the casing 60 for mounting a watchband thereto. Although the description herewithin is given with respect to a wristwatch, use of the invention in a variety of timepieces is contemplated. Such uses include, but are not limited to, pendants, clocks, timers, sundials, and the like.

The circular face 15 of watch 10 includes a single, stationary helical member 50 positioned about a central point, and a step member 55 connecting first and second ends of helical member 50 to form a continuous surface. The configuration of helical member 50 is so that the distance from any point upon the helical member to a horizontal base plane increases along the circumference of the helical member. This distance may increase in either the clockwise or counterclockwise direction so that the helical member is spirally ascending or descending, respectively. Therefore, the connection of the first and second ends of helical member 50 with step member 55 forms upper and lower common edges which extend radially towards the central point. These edges may extend parallel to the horizontal base or may form an angle therewith Also, the edges may be superposed so that the upper edge coincides with the lower edge when watch 10 is viewed along a plane normal to the horizontal base plane.

In the preferred embodiment, at least one edge defines an indicia from which elapsed time is measured. Preferably, this indicia is the 12 o'clock position on face 15. Furthermore, watch 10 is equipped with hour 25, minute 30 and second 35 hands. These hands are securely attached to stem 45 and are driven by any suitable clock mechanism so that the hands rotate about face 15. Accordingly, the position of the hands relative to the indicia defined by at least one of the edges will indicate the time of day.

As shown in FIGS. 1 and 2, the common edges formed between helical member 50 and step member 55 may converge to the central point. As described in applicants, parent application, however, these edges may terminate at a geometric shape formed on face 15, to further enhance the aesthetic value of the watch.

While hands are shown on the drawing as the preferred method of indicating time, other time indicating means are available. For example, watch 10 may be equipped with means for sequentially illuminating portions of face 15, in addition to at least one hand. In this embodiment, the illuminated portion could represent the hour while the moving hand would represent the minute. Still other combinations of illumination means and moving members are contemplated in this invention.

In addition to hands or illuminating means, numerals, or other indicia may be incorporated onto face 10 to facilitate time telling. Indicia such as jewels, posts or a variety of geometric shapes could be positioned at predetermined locations about the central point. However, while such symbols may facilitate time telling, they may also detract from the aesthetic simplicity of the helical design.

Crystal 20 is made of any suitable transparent material, such as glass or plastic, and is attached to face 15 to protect the hands and the surface of face 15 from dust, water and other external sources. The perimeter of crystal 20 preferably corresponds to that of face 15 in both size and shape, although this is not essential to the design. More importantly, a lower portion of crystal 20 is configured to mate with the continuous surface of face 15. That is, the lower portion includes a helical section corresponding to helical member 50 and a recess corresponding to step member 55. Crystal 20 may be glued, press fit or fastened to face 15 by any suitable means.

Watch 10 also has a pair of posts 40 on opposite ends of the casing 60 that a watchband may be attached thereto. Instead of posts 40, or in addition to them, watch 10 may be equipped with other means, such as a hook or recess, for attachment to other support members.

Figure 4:
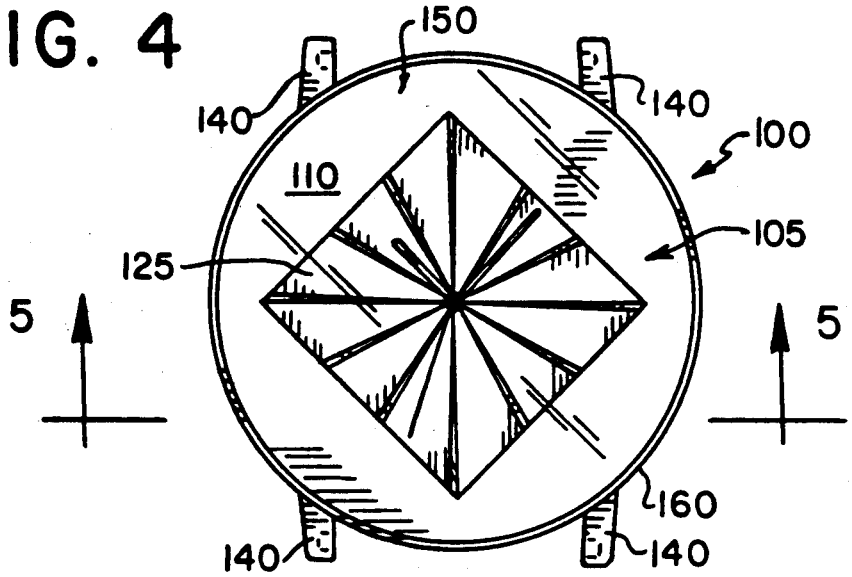
FIG. 4 is a top view of a watch having another face according to the invention.
Figure 5:
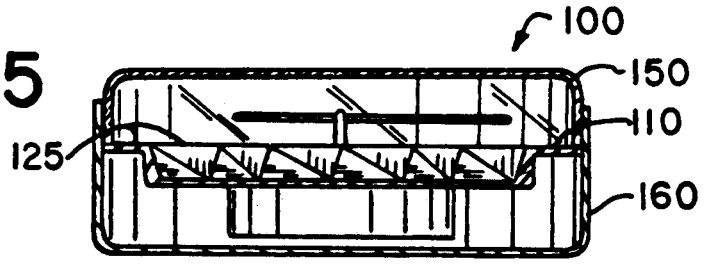
FIG. 5 is a side view, partially in cross-section of the watch of FIG. 4, taken along lines 5—5 thereof.

FIGS. 4 and 5 illustrate another watch 100 according to the invention. In this embodiment, the watch includes crystal 150, casing 160, and posts 140 for attaching a watchband thereto. Also, face 105 has a flat outer periphery 110 which surrounds a plurality of adjacent plane members 125, as described in the inventor's earlier U.S. Patent mentioned above.

The flat outer periphery 110 of the horizontal base plane allows attachment of a standard crystal 150 to this watch. The plurality of plane members 125 are arranged in the shape of a square around the central point where the support for the hands passes therethrough. In this embodiment, the plane members are oriented in a symmetric and continuous pattern. However, other patterns, both discontinuous around the center point as well those which are non-symmetric around the center point, can be used.

Figure 6:
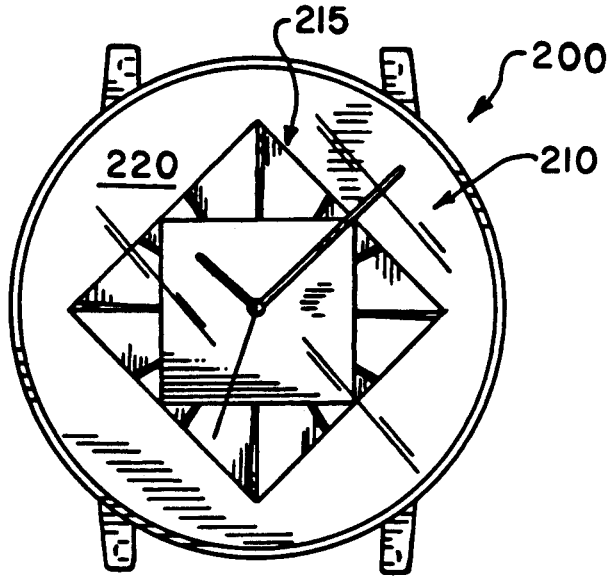
FIGS. 6, through 10 are top views of additional watch faces according to the invention.

FIG. 6 illustrates a watch 200 having a face 210 which is semi-continuous around the center point. The members 215 form a square around a square, where two members in the form of a triangle having a common corner with two adjacent members. Again, the members are mounted upon the horizontal base member 220, which forms the outer perimeter of the face.

Figure 7:
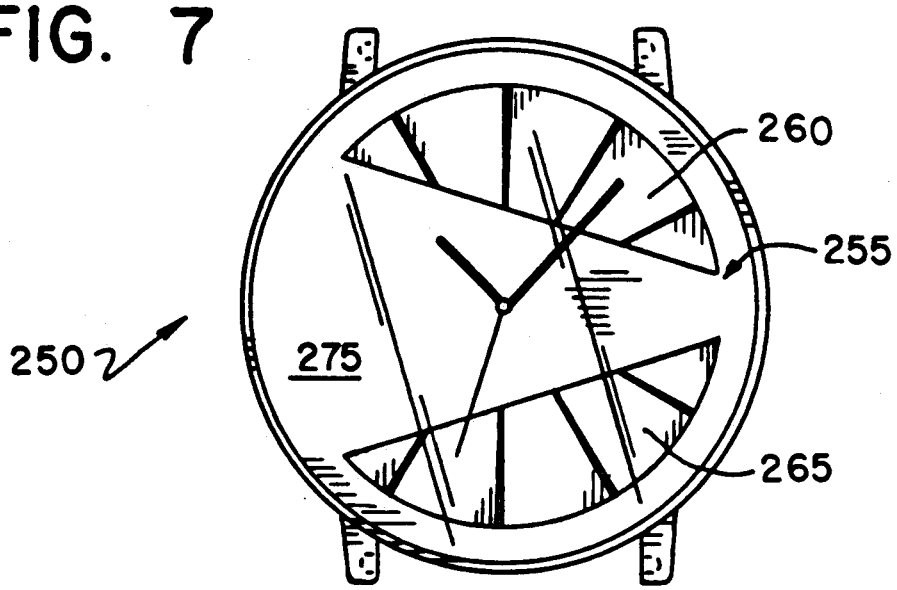

FIG. 7 shows a watch 250 having a face 255 which includes a first plurality of members 260 and a second plurality of member 265 which do not contact each other but which are symmetric around a line extending between the 3 and 9 o'clock positions. Also, the horizontal base plane 275 connects the first and second plurality of members and provides an external perimeter for the face so that a standard crystal can be attached. As noted above, the specific size, shape, configuration and position of the face members with the horizontal base member are limited only by the imagination of one skilled in the art having the benefit of this specification before him.

Figure 8:
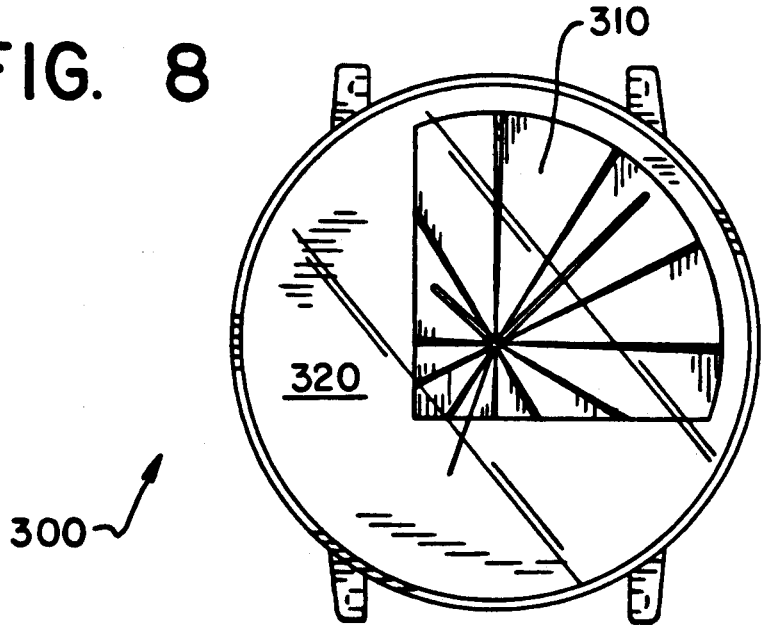

FIG. 8 illustrates another face design which includes a continuous pattern of adjacent plane members around the central point. There is no symmetry with respect to the position of the planes. Again, the horizontal base plane 320 forms the perimeter of the face so that a standard crystal can be attached.

Figure 9:
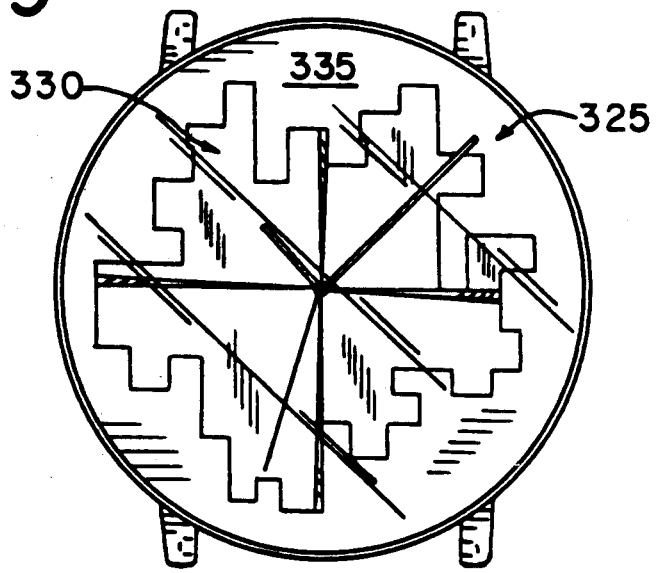

FIG. 9 illustrates an embodiment where face 325 includes an unsual pattern 330 of four members. As above, the pattern 330 of members is within the outer perimeter of the horizontal base plane 335 so that a standard crystal can be attached.

While four members are illustrated in FIG. 9, this is not critical to the invention. Generally, any time interval of a numerical division of 60 (i.e., from 1 to 60) is possible, with lower even numbers such as 1, 2, 4, 6 or 12 being preferred.

Figure 10:
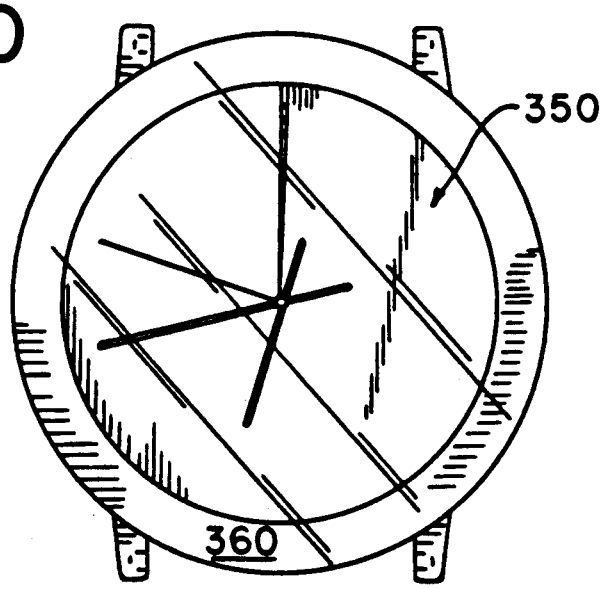

FIG. 10 illustrates an alternate embodiment of the watch of FIGS. 1—3 wherein the helical member 350 is recessed within the horizontal base member 360. Again, this facilitates attachment of a standard crystal without having to compensate for the step in the helical member 350. Although the sweep of the hands is within the recessed area, one skilled in the art will observe that the hands could extend beyond the perimeter of the recessed area, if desired.

Although each of the drawing figures illustrate a watch having a round face, one skilled in the act will realize that the invention is operable with any shape face, such as oval, rectangular, square and the like. Also, although watch faces are illustrated, the invention is fully useful for any type of closk or other time-measuring device.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. An apparatus for indicating time comprising:
(a) a face having a stationary helical member positioned about a central point wherein the distance between any point upon the helical member relative to a horizontal base plane increases along the circumference of said helical member, and a single step member connecting the ends of said helical member to form an indicia from which elapsed time is measured and a continuous surface about said central point; and
(b) means operatively associated with said step member for determining elapsed time;
(c) wherein said time determining means comprises a pair of hands which move relative to said continuous surface whereby the position of said hands relative to said radial edges indicates elapsed time.

2. The apparatus of claim 1 wherein the connection of said helical member and said step member forms upper and lower common edges which extend radially towards said central point.

3. The apparatus of claim 2 wherein said edges extend parallel to said horizontal base plane.

4. The apparatus of claim 2 wherein said edges extend at an angle to said horizontal base plane.

5. The apparatus claim 2 wherein at least one of said radial edges defines said indicia from which elapsed time is measured.

6. The apparatus of claim 5 wherein in said at least one radial edge corresponds to a 12 o'clock position.

7. The apparatus of claim 1 wherein the distance between the helical member and the base plane increases in a clockwise direction.

8. The apparatus of claim 1 wherein the distance between the helical member and the base plane increases in a counterclockwise direction.

9. The apparatus of claim 1 further comprising a crystal attached to said surface for protection of said face and time determining means.

10. The apparatus of claim 9 wherein said crystal has a periphery corresponding to an external periphery of said continuous surface and wherein a lower portion of said crystal periphery is configured to mate and engage said continuous surface.

11. The apparatus of claim 10 wherein said lower portion of said crystal periphery is provided with a recess corresponding to said step member.

12. The apparatus of claim 1 which further comprises means for attaching said face to a support member.

13. The apparatus of claim 12 wherein the attachment means comprises a pair of posts for mounting a watchband thereto.

14. The apparatus of claim 2 wherein said upper and lower radial intersect with an terminate at a shape at a predetermined distance from said central point.

15. The apparatus of claim 1 wherein an external periphery of said continuous surface is substantially circular.

16. An apparatus for indicating time comprising:
(a) a face having a stationary helical member positioned about a central point wherein the distance between any point upon the helical member relative to a horizontal base plane increases along the circumference of said helical member, and a single step member connecting the ends of said helical member to form an indicia from which elapsed time is measured and a continuous surface about said central point; where said helical member includes an outer periphery which is located within the outer perimeter of said horizontal base plane and further wherein the outer perimeter of said horizontal base plane forms the outer perimeter of said face;
(b) means operatively associated with said step member for determining elapsed time; and
(c) wherein said time determining means comprises a pair of hands which move relative to said continuous surface whereby the position of said hands relative to said radial edges indicates elapsed time;
(d) a crystal attached to said horizontal base plane for protection of said face and time determining means.

17. The apparatus of claim 16 wherein the connection of said helical member and said step member forms upper and lower common edges which extend radially towards said central point.

18. The apparatus of claim 17 wherein said edges extend parallel to said horizontal base plane.

19. The apparatus of claim 17 wherein said edges extend at an angle to said horizontal base plane.

20. The apparatus of claim 19 wherein at least one of said radial edges defines said indicia from which elapsed time is measured.

21. The apparatus of claim 20 wherein said at least one radial edge corresponds to a 12 o'clock position.

22. The apparatus of claim 21 wherein said time determining means comprises a pair of hands which move relative to said continuous surface whereby the position of said hands relative to said radial edges indicates elapsed time.

23. The apparatus of claim 16 wherein the distance between the helical member and the base plane increases in a clockwise direction.

24. The apparatus of claim 16 wherein the distance between the helical member and the base plane increases in a counterclockwise direction.

25. The apparatus of claim 16 which further comprises means for attaching said face to a support member.

26. The apparatus of claim 5 wherein the attachment means comprises a pair of posts for mounting a watchband thereto.

27. The apparatus of claim 16 wherein the external periphery of said helical member is substantially circular.

28. An apparatus for indicating time consisting essentially of:

(a) a face having a stationary helical member positioned about a central point wherein the distance between any point upon the helical member relative to a horizontal base plane increases along the circumference of said helical member, and a single step member formed form upper and lower common edges connecting said step member with said helical member, said edges extending radially toward said central point, with at least one of said edges corresponding to a 12 o'clock position and defining an indicia form which elapsed time is measured, said helical and step members forming a continuous surface about said central point; and (b) means operatively associated with said indicia defined by said at least one radial edge for determining elapsed time, said time determining means comprising a pair of hands which move relative to said continuous surface whereby the position of said hands relative to said indicia defined by said at least one radial edge indicates elapsed time.

* * * * *